United States Patent [19]

Wilson

[11] Patent Number: 4,759,455

[45] Date of Patent: Jul. 26, 1988

[54] CHILD RESISTANT CLOSURE WITH DEFORMABLE PANEL

[75] Inventor: Woodrow S. Wilson, Johnston, R.I.

[73] Assignee: Polytop Corporation, Slatersville, R.I.

[21] Appl. No.: 43,783

[22] Filed: Apr. 29, 1987

[51] Int. Cl.[4] ..... B65D 55/02; A61H 1/00

[52] U.S. Cl. ..... 215/206; 215/211; 215/235; 215/237; 215/224; 222/153; 222/517; 222/543; 222/546

[58] Field of Search ..... 215/211, 216, 235, 237, 215/224; 222/153, 517, 543, 546

[56] References Cited

U.S. PATENT DOCUMENTS

| | | | |
|---|---|---|---|
| 3,528,581 | 9/1968 | Lange, Jr. . | |
| 3,599,821 | 8/1971 | Eggert et al. . | |
| 3,603,470 | 9/1971 | Armour . | |
| 3,625,386 | 12/1971 | Schaefer . | |
| 3,759,411 | 9/1973 | Horvath . | |
| 3,790,015 | 2/1974 | Imamura . | |
| 3,850,326 | 11/1974 | Ryles . | |
| 4,010,875 | 3/1977 | Babiol . | |
| 4,209,100 | 6/1980 | Uhlig . | |
| 4,220,248 | 9/1980 | Wilson et al. . | |
| 4,235,349 | 11/1980 | Uhlig . | |
| 4,244,495 | 1/1981 | Lorscheid et al. . | |
| 4,377,247 | 3/1983 | Hazard et al. | 215/235 |
| 4,401,225 | 8/1983 | Schwaikert . | |
| 4,513,888 | 4/1985 | Curry . | |
| 4,533,058 | 8/1985 | Uhlig | 215/216 |
| 4,625,898 | 12/1986 | Hazard | 215/235 |
| 4,629,081 | 12/1986 | McLaren | 215/211 |

*Primary Examiner*—George T. Hall

*Attorney, Agent, or Firm*—Karen M. Gerken

[57] ABSTRACT

A child resistant dispensing closure characterized by a closure member and a lid member which is mounted on the closure member for movement between closed and open positions. A peripheral edge of the lid member abuts an annular shoulder provided on the closure member in the closed position, the point of abutment being concealed by an annular ring provided on the closure member. In the closed position, thickened portions provided on the peripheral edge of the lid member engage in recesses formed in the annular shoulder. The lid member is adapted to be moved upwardly from the closed to an open position when a user applies with one hand a manual compressive force to a panel provided on the exterior skirt of the closure member. This manual force results in deformation of the panel inwardly into a slot formed clearly through an enlarged portion of the shoulder. As a result, a slight separation occurs between the peripheral edge of the lid member and the shoulder so as to allow the user, with the other hand and while continuing to compress the panel, to engage the peripheral edge of the lid member for moving the lid member to the open position.

20 Claims, 4 Drawing Sheets

CHILD RESISTANT CLOSURE WITH DEFORMABLE PANEL

BACKGROUND OF THE INVENTION

1. Field of the Invention

This invention pertains generally to a child resistant dispensing closure. More particularly, the invention relates to a child resistant dispensing closure of the type comprising a closure member and a lid member mounted upon the closure member in such a way as to be capable of being manipulated so as to prevent or permit material being moved through the dispensing closure. The invention contemplates a dispensing closure of the foregoing type wherein manipulation of the lid member from a closed position, wherein material is prevented from passing through the dispensing closure, to an open position, wherein material is allowed to pass through the dispensing closure and, hence, be dispensed, is accomplished only by deformation of a portion of the closure member. The requirement for specific deformation action effectively precludes access by children to the contents of a container to which the dispensing closure is attached.

The term "dispensing closure" is commonly utilized to designate closures which are normally adapted for attachment to the necks of containers such as bottles, tubes, or the like. Such dispensing closures, as are commonly known, generally include a closure member adapted to be secured to or formed integrally with a container and a lid member which is mounted on the closure member for movement between open and closed positions. In the open position, material can be moved through an opening in the closure member, while in the closed position such opening is closed off or sealed.

It has been previously recognized that the utility of a dispensing closure in many different types of applications can be enhanced or improved by constructing such a closure so that the lid member is normally held in an open position once it has been moved into such position, until such time as deliberate force is applied by the user to close such a lid member.

Various expedients and structures have been utilized in the prior art in order to obtain the foregoing attributes. Examples of dispensing closures of this type are found in U.S. Pat. No. 4,172,540 and in U.S. Pat. No. 4,220,248. U.S. Pat. No. 4,172,540, issued on Oct. 30, 1979 to Erichson, discloses a dispensing closure having a cap and a lid mounted thereon by means of a spring. The spring serves to hold the lid relative to the top of the cap so that the lid is held against movement when in the open position. U.S. Pat. No. 4,220,248, issued on Sept. 2, 1980 to Wilson et al, is directed to a closure member and lid wherein a spring structure and a cam structure cooperate to hold the lid in an open or closed position.

The latter dispensing closure structures are considered to be highly desirable from a unitarian standpoint in that the lid member is prevented from interfering with the discharge of material through such closures. Additionally, dispensing closures as so described may be easily and conveniently manufactured at a nominal cost and are of such a character that they afford facility of use over a prolonged period. Moreover, these dispensing closures are advantageous because of their simplicity, because the manner in which they are constructed makes it possible to utilize them without danger of damage during handling, installation and the like, and because they are aesthetically satisfying.

While the attributes of the foregoing dispensing closures are numerous, the need exists to provide such closures with an effective means for preventing unwanted access to potentially harmful contents of the container with which the closure is associated. The need for dispensing closures with child resistant features is precipitated by the extensive home and personal usage and consumption of potentially injurious substances such as medicaments, pharmaceuticals, cosmetics, cleaning preparations and the like. Thus, the need exists for a dispensing closure that not only possess the diverse attributes discussed above, but which is relatively difficult to open so that comparatively young children or those of reduced mental capacity cannot open them under normal circumstances. However, the dispensing closure must also be sufficiently easy to open so that it may be operated by individuals of normal mental capacity, even if such individuals do not possess what may be regarded as normal physical strengths.

Previous attempts to provide dispensing closures of a child resistant character have often resulted in structures which, due to their complexity, were prohibitively expensive to manufacture for commercial utilization. Additionally, complicated construction often rendered the closure difficult to operate, even by an adult, requiring complicated manipulations and/or considerable force. Those closures wherein the child resistant feature depends upon the application of relatively great strength, are particularly flawed in that a small child may be stronger than an elderly person or someone weakened by illness and the closure, therefore, inevitably fails to fulfill its child resistant purpose. The child resistant features which require unusually complex manipulations are, in reality, impractical to use and are destined to fail in gaining commercial acceptance. The more simple structures which have been adopted have generally proved to be disappointing in responding to child resistant demands, being easily penetrable, deliberately or inadvertently, by an average child.

The instant invention addresses the foregoing problems and deficiencies by providing a dispensing closure characterized by a lid member and a closure member, wherein the lid member is adapted to be maintained in an open position in which the lid member does not interfere with the dispensing of a product through the closure member and wherein the lid member may be moved from the closed position to the open dispensing position only by applying manual pressure, by means of the user's thumb, to a portion of the closure member. This application of manual pressure causes the closure member to be deformed so as to produce a small separation of the lid member and the closure member from the position wherein said members normally abut in the closed position. While continuing to apply this manual compressive force, the user may then, with the opposite free hand, engage a portion of the lid member by means of a finger, fingernail or small object in order to move the lid member upwardly into the open position.

The requirement for a manual compressive force in order to operate the dispensing closure presents a reliable and effective child resistant feature in that it addresses and overcomes the universal inherent tendency of a child to separate parts by directly pulling them apart. Additionally, this force or pressure must be applied to a specific portion of the closure member by the finger, and preferably the thumb, of the user while the dispensing closure is grasped by the hand. It is highly improbable that a child or other individual of impaired mental ability would discover, intentionally or inadvertently, the very limited area to which the manual force must be applied. Furthermore, the instant dispensing closure necessitates for operation the additional action, simultaneous with the application of the manual force, of engaging and moving the lid member with the opposite hand. This series of movement requires for execution such dexterity, coordination and mental skill that are normally beyond the capabilities of the ordinary child or other individual of reduced mental ability.

2. Description of the Prior Art

Dispensing closures of the broad type wherein a portion of the closure is required to be deformed by the user as a step in gaining access to the contents of the associated container are known in the prior art. For example, U.S. Pat. No. 3,528,581, issued on Apr. 29, 1968 to Lange, Jr., discloses a safety cap for a container wherein access to the contents of the receptacle is gained by manually pressing the collar of the cap in the direction of the receptacle so that a closure member can be pulled away from engagement with the mouth of the receptacle.

U.S. Pat. No. 3,603,470, issued on Sept. 7, 1971 to Armour shows a closure which is unlocked by applying an inward compressive force to the outer surface of the skirt of the closure to disengage the skirt from an overcap hingedly connected thereto.

U.S. Pat. No. 3,790,015, issued Feb. 5, 1974 to Imamura, is directed to a container having a cap which may be removed by pressing inwardly on the container wall.

U.S. Pat. No. 3,850,326, issued on Nov. 26, 1974 to Ryles, discloses a safety closure having an opening formed therein and a snap-on lip adapted to open and close the opening. A portion of the outer surface of the closure is displaceable inwardly to allow a finger of the user to engage under the lid to overcome its snap action.

U.S. Pat. No. 4,010,875, issued on Mar. 8, 1977 to Babiol, teaches a stoppering device hingedly connected to a closure cap. Manual pressure on a peak of the cap causes the latter to pivot with respect to the stoppering device.

U.S. Pat. No. 4,209,100, issued June 24, 1980 to Uhlig, discloses a safety closure having a wall segment adapted to be pressed inwardly for freeing a locking flap from sealing engagement with an opening in the closure.

U.S. Pat. No. 4,513,888, issued Apr. 30, 1985 to Curry, discloses a dispensing cap having a flexible panel which must be manually depressed inwardly to expose a portion of the cover.

The prior art fails to provide a dispensing closure characterized by a lid member that is prevented from interfering with the associated closure member when the lid member is in the open position, and wherein the lid member may be manipulated from a closed position to the open position by application of a manual compressive force by means of the user's finger to a specific portion of the closure member while simultaneously engaging the lid member with the opposite hand to move the lid member upwardly with respect to the closure member to achieve the open dispensing position.

SUMMARY OF THE INVENTION

The invention is directed to a dispensing closure of the type comprising a closure member adapted to be secured to a container or other receptacle and a lid member which is movable from a closed position wherein the lid member closes off a dispensing opening in the closure member and an open position wherein such dispensing opening is unobstructed. The lid member is mounted on the closure member for movement with respect thereto to achieve the open and closed positions with means being provided to positively prevent the lid member from interfering with the closure member when the lid member is in the open position.

The closure member is provided with an annular recessed shoulder against which the peripheral edge of the lid member is adapted to abut when the lid member is in the closed position. In such closed position, thickened portions on the peripheral edge of the lid member engage corresponding recesses formed in the shoulder of the closure member in locking relationship. The point of abutment of the peripheral edge of the lid member and the shoulder of the closure member is concealed by a raised annular ring provided on the closure member, the ring appearing to be an extension of the exterior skirt of the closure member. The point of abutment between the lid member and the closure member is thus effectively isolated from the tampering efforts which may be exerted by a child.

An arcuate slot is formed clearly through an enlarged portion of the shoulder of the closure member slightly spaced inwardly from the exterior skirt. A smooth panel is provided on the outer surface of the exterior skirt at the location of the slot for the purpose of providing a specific area to which a user must apply a manual force in order to be able to initiate movement of the lid member from the closed to the open position. This manual force is applied by the user pressing inwardly with the thumb of one hand on the smooth panel so as to deform the panel, and hence the exterior skirt of the closure member, inwardly toward the slot. This deformation causes a slight separation at the location of the slot between the normally abutting peripheral edge of the lid member and the shoulder of the closure member. The user may then, with the opposite free hand, engage the peripheral edge of the lid member and move the lid upwardly with respect to the closure member so as to disengage the thickened portions on the lid member from the recesses in the shoulder of the closure member and to achieve the open position for the lid member.

The requirement for an application of manual force with one hand to a very specific area of the closure member, while simultaneously engaging the lid member with the other hand and moving the lid member to the open position, necessitates physical and mental skill and coordination not possessed by the ordinary child.

DETAILED DESCRIPTION OF THE PREFERRED EMBODIMENT

Figure 1:
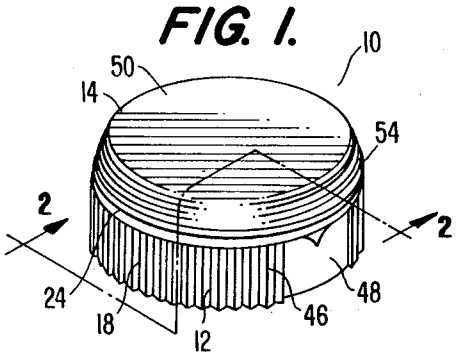
FIG. 1 is a perspective view of the preferred embodiment of the child resistant dispensing closure of the present invention showing the dispensing closure in the fully closed position.

Referring to FIGS. 1-4, there is shown a child resistant dispensing closure according to the present invention indicated generally at 10. The dispensing closure is constructed as a unitary body by conventional injection molding techniques out of any one of a wide variety of known somewhat flexible, somewhat resilient, polymer materials. Various polyolefins such as polyethylene or polypropylene may be effectively utilized.

The child resistant dispensing closure comprises a closure member or cap 12 connected to a lid member 14 by means of an integral, so-called "living" hinge 16. The closure member is defined by a first generally cylindrical exterior depending skirt 18 and a top surface 20. An annular recessed shoulder 22 is provided around the periphery of the top surface 20 between the top surface and the exterior skirt 18.

Figure 2:
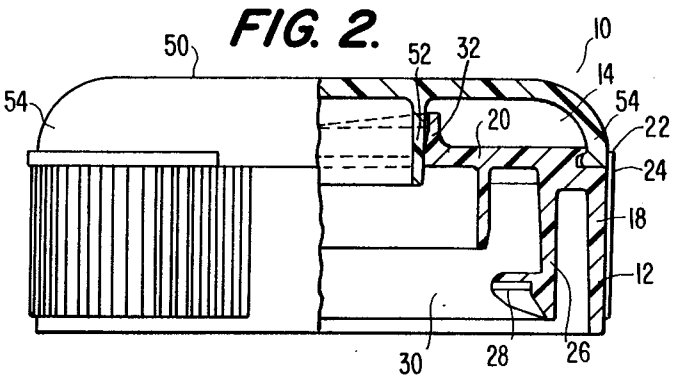
FIG. 2 is an exploded sectional view of the child resistant dispensing closure of FIG. 1 taken through line 2—2 of FIG. 1.
Figure 3:
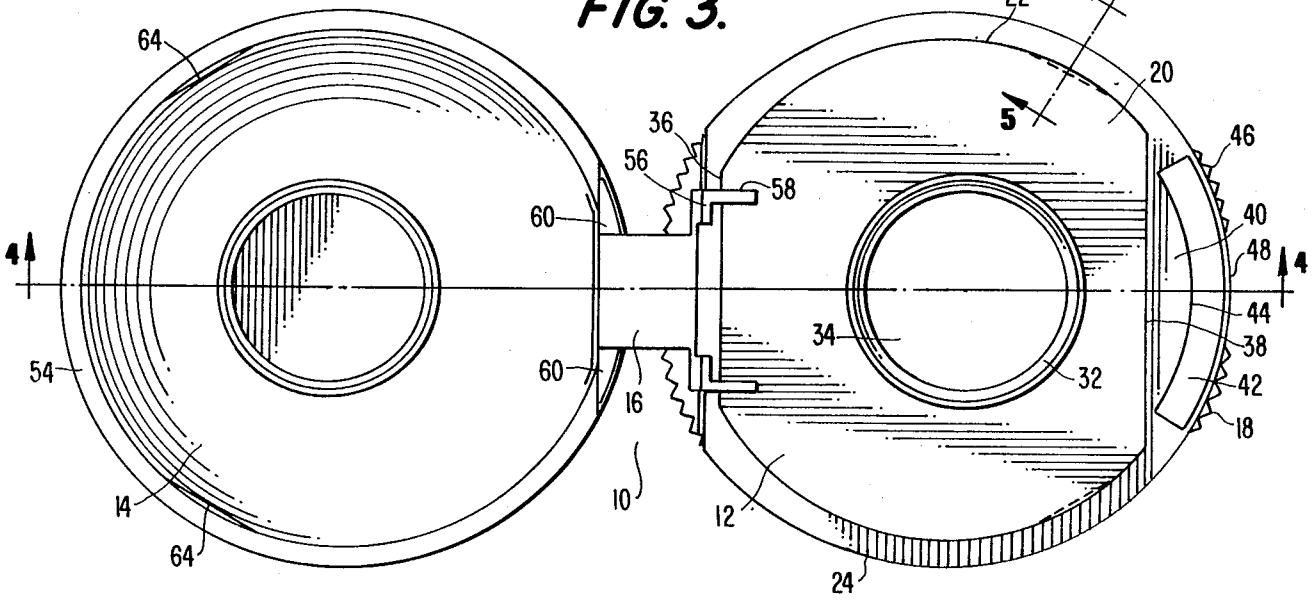
FIG. 3 is an exploded top plan view of the child resistant dispensing closure of FIG. 1 showing the dispensing closure in the fully open position.

As best depicted in FIGS. 2 and 3, an integral raised annular ring 24 is provided on the upper peripheral edge of exterior skirt 18. The annular ring projects above the annular recessed shoulder 22 at generally the same height as top surface 20. The upper edge of the ring, as illustrated in FIG. 3, is generally concentric with the top surface 20.

A second generally cylindrical interior depending skirt 26 extends downwardly from the top surface spaced from and concentric with exterior skirt 18. Interior skirt 26 is provided with means, such as undercut flange 28, for securing the interior skirt to the neck of a container (not shown). When so secured, the exterior skirt 18 and the container define a continuous aesthetically satisfying and symmetrical configuration of an enclosed receptacle. It should be noted that the interior skirt 26 may alternatively, be formed integral with a bottle, tube or other container. Additionally, other similar known means may be utilized instead of undercut flange 28 for mounting the closure on a bottle, tube or the like.

A dependent cylindrical sealing element 30 extends downwardly from top surface 20 interior of and concentric with interior skirt 26. The sealing element is adapted to fit within the neck of the associated container to form a seal therewith. Obviously, various equivalent sealing structures may be employed in conjunction with the dispensing closure. A nozzle-like boss 32 is provided on the top surface 20 interiorly of the sealing element around an opening 34 extending through the top surface and providing communication with the interior of the associated container.

With particular reference to FIG. 3, top surface 20 is provided with a first straight edge 36 proximate hinge 16. A second straight edge 38 is provided in the top surface parallel to and directly opposite from first straight edge 36. With further reference to FIG. 3, second straight edge 38 and exterior skirt 18 define an enlarged portion 40 of the annular shoulder 22. An arcuate slot 42 is formed in this enlarged portion and generally conforms to the arc of a circle defined by exterior skirt 18. The inner wall 44 of the slot, illustrated in FIG. 4, is formed by interior skirt 26, the slot extending clearly through the enlarged portion 40.

The outer surface of the exterior skirt 18 may be provided therearound with serrations 46 which may, if desired, extend onto the annular ring 24. These serrations, as well as the ring 24, are interrupted at the location of the center of the slot by a smooth panel 48, as can be seen in FIGS. 1 and 3. The panel is wide enough to accommodate the finger and, in particular, the thumb of a user.

The lid member 14 includes a substantially flat top 50 which carries a plug member 52 adapted to fit within the opening 34 formed in closure member 12 so as to close off the opening when the lid is in the closed position of FIG. 2. The lid is further defined by a skirt 54, one end of which is connected to a straight edge 56 provided in the recessed shoulder 22 of closure member 12 by means of hinge 16. With reference to FIG. 3, it can be seen that straight edge 56 is parallel to, and slightly spaced from, the first straight edge 36 of top surface 20.

Figure 4:
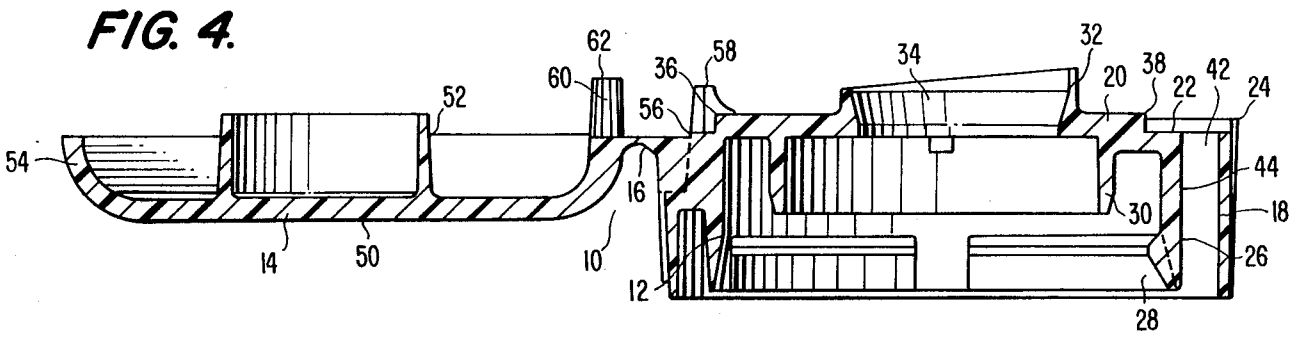
FIG. 4 is a sectional view of the child resistant dispensing closure of FIG. 3 taken along line 4—4.

The lid member 14 may be pivoted substantially about an axis (not shown) from a fully open position, as indicated in FIGS. 3 and 4 extending outwardly from the closure member 12, in which it is formed by an injection molding operation to a closed position depicted in FIGS. 1 and 2. In this closed position, the edge of the skirt 54 of the lid member 14 abuts against the recessed shoulder 22 inside of the raised ring 24. The skirt 54 thus appears to be a continuation of the exterior skirt 18 of the closure member 12. Moreover, the point at which the edge of skirt 54 and the shoulder 22 abut is effectively concealed behind the raised ring 24, thereby preventing a child from attempting to pry the lid member away from the closure member, intentionally or otherwise, by means of fingers, teeth or other objects applied to the point of abutment.

Two separate, upstanding posts 58, serving essentially as leaf springs, project upwardly from recessed shoulder 22 along straight edge 56 on opposite sides of hinge 16. With reference to FIG. 4, the posts extend upwardly for a distance beyond top surface 20. These posts are located such that they are capable of being engaged by cam lugs 60 provided on the lid member. Alternatively, the posts could take the form of vertical cam surfaces which cooperate with cam followers or lugs extending from the lid member, one on each side of the hinge.

Cam lugs 60 are situated on the lid member 14 so as to in effect constitute extensions of the skirt 54 on opposite sides of hinge 16. During movement of the lid member 14 from the fully open position of FIGS. 3 and 4 to the closed position of FIGS. 1 and 2, ends 62 of the cam lugs 60 will abut against the posts 58 so as to push upon these posts and temporarily distend them. The cam lugs 60 are dimensioned so that, as the lid reaches a closed position, the cam lugs will be located generally along side of and next to the posts 58. It should be recognized that this type of position is "stable". When the lid member 14 is in this closed position the posts 58 will not be under any continuing pressure such as might cause a degree of creeping or deformation.

Figure 5:
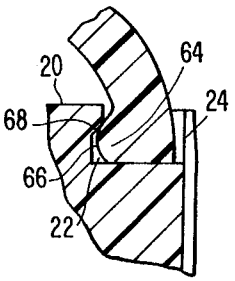
FIG. 5 is an exploded fragmentary sectional view of the child resistant dispensing closure of FIG. 3 taken along line 5—5 and showing the relationship between the lid member and the closure member in the closed position.
Figure 6:
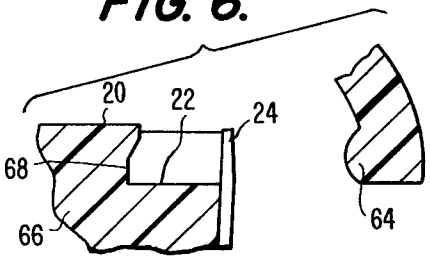
FIG. 6 is a view of one of the thickened portions and the recessed shoulder of FIG. 5.

Lid member 14 is further provided at the edge of the skirt 54 with two separate thickened portions 64. These thickened portions, which can be seen in FIG. 3 and are illustrated in cross-section in FIGS. 5 and 6, are somewhat hook-shaped in cross-section so as to engage with corresponding recesses 66 formed in the vertical wall 68 between top surface 20 and recessed shoulder 22. Thickened portions 64 engage recesses 66 so as to provide for a locking engagement between the lid member and the closure member in the closed position and to inhibit a child's ability to pry the lid member away from the closure member. This feature, in conjunction with concealment by the raised ring 24 of the point of abutment between skirt 54 of the lid member against the shoulder 22 of the closure member effectively precludes unauthorized operation of the dispensing closure by children or other individuals of reduced mental capacity for whom the contents of the container might be harmful, and even fatally injurious.

The child resistant dispensing closure is opened when sufficient manual pressure is applied, by means of the user's thumb, inwardly to the smooth panel 48 of the exterior skirt 18 so as to compress the panel inwardly into the open area of the slot 42, the slot being completely open at the top and bottom. When the panel, and hence the lower portion of the exterior skirt 18, is deformed inwardly toward interior skirt 26, a slight separation occurs at the location of the slot between the edge of skirt 54 of the lid member and the shoulder 22 of the closure member where these latter two elements normally abut in the closed position. It is then possible for the user, while continuing to apply pressure to the panel 48, to utilize the other hand to engage, by means of a fingernail or small tool, the edge of skirt 54 of the lid member in order to initiate movement of the lid member to the open position. Movement of the lid member with the free hand acts to disengage the hook-shaped thickened portions 64 from the recesses 66.

The requirement for inward manual pressure represents an effective child resistant feature in that it overcomes the natural tendency of children to separate parts by attempting to pull them directly apart. Additionally, the child resistant nature of the present dispensing closure is even further enhanced in that operation of the dispensing closure necessitates two diverse but simultaneous actions, each of which must, in effect, be performed with a different hand. This series of movement requires dexterity, coordination and intelligence normally beyond the capabilities of a child or other individual of impaired mental ability.

When the lid member is moved to the open position from a closed position, the ends 62 of the cam lugs 60 again abut and temporarily deform the posts 58 until such time as the cam lugs 60 are approximately perpendicular to the posts 58. The lid is thus held so that it cannot swing back toward a closed position so as to interfere with the discharge of material through the opening 34, which opening is then unobstructed in order for the contents of the container to pass therethrough. When it is desired to close the lid member, it can be moved back to a closed position as discussed herein.

Figure 7:
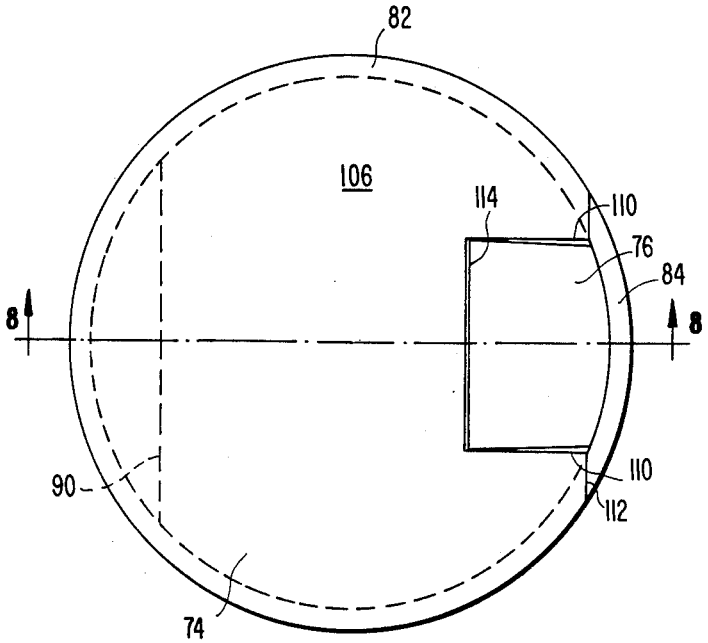
FIG. 7 is a top plan view of a first alternative embodiment for the child resistant dispensing closure.
Figure 8:
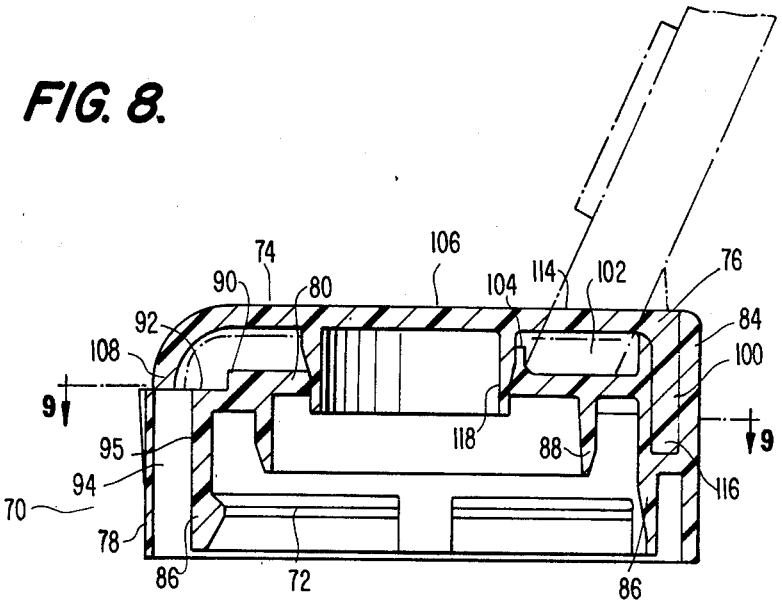
FIG. 8 is a side sectional view of the first alternative embodiment of FIG. 7 taken along line 8—8 and showing the dispensing closure in the fully closed position with the open position indicated in phantom.
Figure 9:
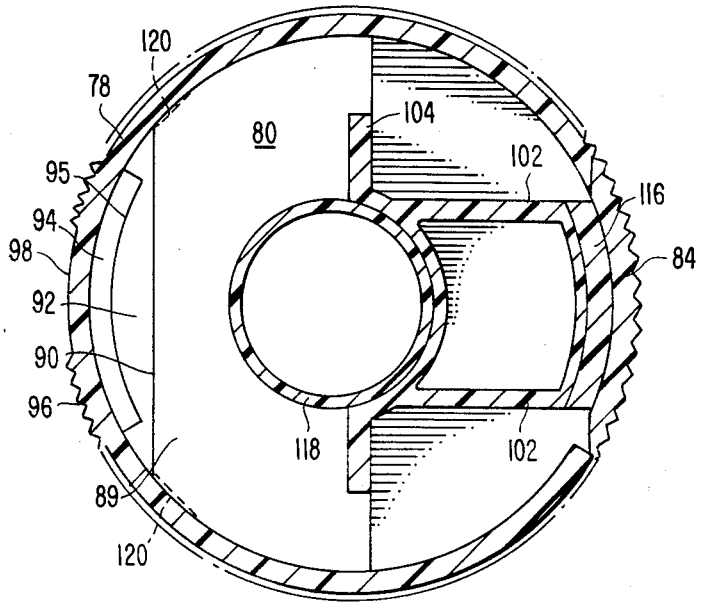
FIG. 9 is a sectional view of the child resistant dispensing closure of FIG. 8 taken along line 9—9.

FIGS. 7, 8 and 9 depict a first alternative embodiment for the child resistant dispensing closure of the present invention. As depicted therein dispensing closure 70 comprises a closure member 72 and a lid member 74. The lid member 74 is preferably constructed so as to be integral with a spring 76. The lid member and the spring are integrally formed by known injection molding techniques. The lid member, the spring and the closure member are formed of a somewhat flexible, somewhat resilient, polymer material.

The closure member is defined by a first generally cylindrical exterior depending skirt 78 and a top surface 80. An annular recessed shoulder 82, shown in broken lines in FIG. 7, is provided around the periphery of the top surface 80, being interrupted at the location of back wall 84. Back wall 84 extends above the top surface and appears as an extension of the exterior skirt 78.

A second generally cylindrical interior depending skirt 86 extends downwardly from the top surface spaced from and concentric with exterior skirt 78. Interior skirt 86 is provided with means suitable for securing the interior skirt to the neck of a container (not shown). A dependent cylindrical sealing element 88 extends downwardly from top surface 80 interior of and concentric with interior skirt 86. An opening 89 is provided in the top surface and leads through the top surface for communication with the interior of the closure member.

Top surface 80 is provided with a straight edge 90 which, together with exterior skirt 78, define an enlarged portion 92 of the annular shoulder 82. An arcuate slot 94 is formed in this enlarged portion and generally conforms to the arc of a circle defined by exterior skirt 78. The inner wall 95 of the slot is formed by interior skirt 86, the slot extending clearly through the enlarged portion.

The outer surface of the exterior skirt may be provided therearound with serrations 96 which are interrupted at the location of the center of the slot by a smooth panel 98, as discussed in connection with panel 48 above. It should be understood that the exterior skirt may, if desired, be provided with a raised annular ring as was discussed in connection with the preferred embodiment.

An elongated opening 100 is located in the top surface 80 immediately adjacent the back wall 84. Two parallel ridges 102 extend from the extremeties of the opening 100 generally toward the opening 89. These ridges are connected by a straight elongated wall or ridge 104 extending across the top surface 80.

The lid member 74 is constructed so as to have a generally circular body 106 and an integral annular dependent skirt 108. This body is dimensioned so as to fit over the closure member 72 when the lid member is in the closed position of FIGS. 7 and 8. The skirt 108 is dimensioned so as to abut the annular shoulder 82 provided on the closure member when the lid member is in said same closed position as hereinbefore discussed in connection with FIGS. 1–6.

With reference to FIG. 7, the lid member further includes two inwardly extending slots or cut-outs 110 which extend generally from a straight back edge 112 on the body 106. These two slots 110 extend along the spring 76 when the lid member is in a closed position. The spring 76 is a flat, leaf-type spring which is connected to the body 106 along a line 114 of reduced cross-sectional thickness serving as a pivot so as to pivotally connect the lid member with the spring at one of the ends of the spring. The other end of the spring is formed integral with a mounting tab 116 which extends at a right angle to the spring. This tab 116 fits closely within the opening 100 so as to secure the lid member in place so that it may be moved between a closed position wherein plug member 118 on the lid member is received within the opening 89 in the closure member and an open position wherein the opening 89 is unobstructed.

The spring 76 serves to support the lid member 74 at all times. In the closed position of the lid member, the spring is unstressed and serves to hold the line 114 serving as a pivot generally adjacent to the top surface 80. In this position, the lid member fits against the top surface 80 so as to close off the opening 89. Because of the engagement between the lid member and the top surface 80, the spring 76 in effect biases the lid member in contact with the top so that it cannot be pivoted. In this position, the edge of skirt 108 of the lid member abuts the shoulder 82 on the closure member.

The lid member 74 is provided at the edge of the skirt 108 with two separate hook-shaped thickened portions 120. These thickened portions engage with corresponding recesses (not shown) formed in the vertical wall between the top surface 80 and shoulder 82 so as to provide a locking engagement between the lid member and the closure member in the closed position as previously discussed in connection with the preferred embodiment.

The lid member is adapted to be manipulated to an open position, shown in phantom in FIG. 8, by moving the lid member generally upwardly so as to bend the spring 76. As the lid member is moved upwardly and as the spring is bent, the line 114 is elevated relative to the top surface 80 of the closure member. As this occurs, the lid member may be pivoted to an open position relative to the spring and the top surface. The ridge 104 acts as a stop means engagng the lid member to limit the amount that the lid may be rotated about the line 114 as the spring is deformed.

When the lid member is in contact with the ridge 104 it may be released and it will automatically remain in the open position in which the spring biases the lid member against the top surface and the ridge. The lid member will be held open until such time as the lid member is manipulated to a closed position by pivoting the lid member relative to the line 114 a sufficient extent.

The child resistant dispensing closure of FIGS. 7–9 may be manipulated from the closed to the open position when sufficient manual pressure is applied to the panel 98 of the exterior skirt so as to compress the panel inwardly into the open area of the slot 94 as previously discussed in connection with the embodiment of FIGS. 1–6. When the panel, and hence the lower portion of the exterior skirt 78, is deformed inwardly toward the interior skirt 86, a slight separation occurs at the location of the slot between the edge of the skirt 108 of the lid member and the shoulder 82 of the closure member where the latter two parts normally abut in the closed position. It is then possible for the user, while continuing to apply pressure to the panel, to engage the edge of the skirt of the lid member with the opposite free hand in order to move the lid member to the open position by causing it to pivot around line 114.

While the instant invention has been described with a degree of particularity in connection with a preferred and alternative embodiment, it should be understood that the foregoing disclosure is made by way of example and that many variations and modifications of the details of construction and combination and arrangement of parts herein described will be obvious to those skilled in the art and may be adopted without departing from the spirit and scope of the invention as defined in the appended claims.

What is claimed is:

1. A dispensing closure comprising a closure member and a lid member, said closure member being adapted to be secured to a container, said closure member being defined by a top surface and an exterior skirt, an interior skirt depending from said top surface and being spaced inwardly of said exterior skirt, a dispensing opening provided in said top surface, a shoulder provided on said top surface, a slot formed in a portion of said shoulder, said slot being located between said exterior and interior skirts, a panel member provided on said exterior skirt at the location of said slot, said lid member being connected to said closure member for movement with respect to said closure member from a closed position wherein said lid member closes off said dispensing opening and an open position wherein said dispensing opening is unobstructed, said lid member being defined by a substantially planar top and a dependent skirt, said dependent skirt having a peripheral edge, said peripheral edge being adapted to abut said shoulder when said lid member is in said closed position, said lid member being capable of movement from said closed to said open position by a user applying a manual compressive force to said panel member, said panel member being adapted to deform inwardly into said slot in response to said force, said deformation producing a slight separation between said peripheral edge and said shoulder whereby said lid member may be engaged by the user while continuing to apply said manual force such that said lid member may be moved to the open position.

2. The dispensing closure recited in claim 1 wherein said slot is arcuate in shape, said slot being open at the top and at the bottom.

3. The dispensing closure recited in claim 1 wherein said interior skirt forms the inner wall of said slot.

4. The dispensing closure recited in claim 1 wherein said exterior skirt of said closure member is provided with a raised ring, said ring being adapted to conceal the point of abutment between said lid member and said closure member when said lid member is in said closed position.

5. The dispensing closure recited in claim 1 wherein said panel member is smooth.

6. The dispensing closure recited in claim 1 wherein said peripheral edge of said lid member is provided with at least one thickened portion, said shoulder on said closure member is provided with at least one recess corresponding to said thickened portion, said thickened portion being adapted to engage said recess when said lid member is in said closed position.

7. The dispensing closure recited in claim 1 wherein said closure member and said lid member are integrally formed of a polymer material.

8. A dispensing closure comprising a closure member and a lid member, said closure member being adapted to be secured to the neck of a container, said closure member being defined by a top surface and an exterior skirt, an interior skirt depending from said top surface and being spaced inwardly of said exterior skirt, a dispensing opening provided in said top surface, a shoulder provided on said top surface, a slot formed in a portion of said shoulder, said slot being defined by said exterior skirt and said interior skirt and being open at the top and at the bottom, a panel member provided on said exterior skirt at the location of said slot, a spring member for connecting said lid member to said closure member, said lid member being adapted for movement with respect to said closure member from a closed position wherein said lid member closes off said dispensing opening and an open position wherein said dispensing opening is unobstructed, means for preventing said lid member from interfering with said closure member when said lid member is in said open position, said lid member being defined by a substantially planar top and a dependent skirt, said dependent skirt having a peripheral edge, said peripheral edge being adapted to abut said shoulder when said lid member is in said closed position, at least one thickened portion provided on said peripheral edge, at least one recess corresponding to said thickened portion provided on said shoulder, said thickened portion being adapted for engagement with said recess when said lid member is in said closed position, said lid member being capable of movement from said closed to said open position by a user applying a manual compressive force to said panel member, said panel member being adapted to deform inwardly into said slot in response to said force, said deformation producing a slight separation between said peripheral edge and said shoulder whereby said lid member may be engaged by the user while continuing to apply said manual force such that said lid member may be moved to the open position.

9. The dispensing closure as recited in claim 8 wherein said shoulder is annular, said annular shoulder being provided with an enlarged portion, said slot being arcuate in shape and being formed in said enlarged portion.

10. The dispensing closure as recited in claim 8 wherein said exterior skirt of said closure member is provided with a raised ring, said ring being adapted to conceal the point of abutment between said lid member and said closure member when said lid member is in said closed position.

11. The dispensing closure as recited in claim 10 wherein said ring is formed as a projection of said exterior skirt, said ring being generally coplanar with said top surface.

12. The dispensing closure as recited in claim 8 wherein said exterior skirt is provided with serrations, said serrations being interrupted at said panel members.

13. The dispensing closure as recited in claim 8 wherein said closure member and said lid member are integrally formed of a polymer material.

14. The dispensing closure as recited in claim 8 wherein said means for preventing said lid member from interfering with said closure member comprises a pair of upstanding posts on said closure member and a pair of corresponding cam lugs on said lid member.

15. The dispensing closure as recited in claim 8 wherein said means for preventing said lid member from interfering with said closure member comprises a ridge provided on said closure member, said lid member being adapted to abut said ridge when said lid member is in the open position.

16. A dispensing closure comprising a closure member and a lid member, said closure member being defined by a top surface and an exterior skirt, an interior skirt depending from said top surface and being spaced inwardly of said exterior skirt, means for securing said interior skirt to the neck of a container, a dispensing opening provided in said top surface, an annular shoulder provided on said top surface, an enlarged portion formed in said annular shoulder, an arcuate slot formed in said enlarged portion, said slot conforming to the arc of a circle defined by said exterior skirt, said slot being defined by said exterior and interior skirts and being open at the top and at the bottom, a panel member provided on said exterior skirt at the location of the slot, a spring member connecting said lid member to said closure member, said lid member being adapted for movement with respect to said closure member from a closed position wherein said lid member closes off said dispensing opening and an open position wherein said dispensing opening is unobstructed, means for preventing said lid member from interfering with said closure member when said lid member is in said open position, said lid member being defined by a substantially planar top and a dependent skirt, said dependent skirt having a peripheral edge, said peripheral edge being adapted to abut said shoulder when said lid member is in said closed position, at least one thickened portion provided on said peripheral edge, at least one recess corresponding to said thickened portion provided on said shoulder, said thickened portion being adapted for engagement with said recess when said lid member is in said closed position, a raised annular ring provided on said exterior skirt of said closure member, said ring being formed as a projection of said exterior skirt and being generally coplanar with said top surface, said ring being adapted to conceal the point of abutment between said lid member and said closure member when said lid member is in said closed position, said lid member being capable of movement from said closed to said open position by a user applying a manual compressive force to said panel member, said panel member being adapted to deform inwardly into said slot in response to said force, said deformation producing a slight separation between said peripheral edge and said shoulder whereby said lid member may be engaged by the user while continuing to apply said manual force such that said lid member may be moved to the open position.

17. The dispensing closure as recited in claim 16 wherein said exterior skirt is provided with serrations, said serrations being interrupted at said panel members.

18. The dispensing closure recited in claim 16 wherein said closure member and said lid member are integrally formed of a polymer material.

19. The dispensing closure as recited in claim 16 wherein said means for preventing said lid member from interfering with said closure member comprises a pair of upstanding posts on said closure member and a pair of corresponding cam lugs on said lid member.

20. The dispensing closure as recited in claim 16 wherein said means for preventing said lid member from interfering with said closure member comprises a ridge provided on said closure member, said lid member being adapted to abut said ridge when said lid member is in the open position.

* * * * *